US008419169B2

(12) United States Patent
Pan et al.

(10) Patent No.: US 8,419,169 B2
(45) Date of Patent: Apr. 16, 2013

(54) INKJET PRINTHEAD AND METHOD EMPLOYING CENTRAL INK FEED CHANNEL

(75) Inventors: Alfred I-Tsung Pan, Sunnyvale, CA (US); Erik Torniainen, Albany, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/260,075

(22) PCT Filed: Jul. 31, 2009

(86) PCT No.: PCT/US2009/052358

§ 371 (c)(1), (2), (4) Date: Sep. 23, 2011

(87) PCT Pub. No.: WO2011/014180

PCT Pub. Date: Feb. 3, 2011

(65) Prior Publication Data

US 2012/0120157 A1 May 17, 2012

(51) Int. Cl.
*B41J 2/05* (2006.01)

(52) U.S. Cl.
USPC ..... 347/65; 347/56; 347/63

(58) Field of Classification Search ..... None
See application file for complete search history.

(56) References Cited

U.S. PATENT DOCUMENTS

| | | | | |
|---|---|---|---|---|
| 4,791,435 | A | 12/1988 | Smith et al. | |
| 4,870,433 | A * | 9/1989 | Campbell et al. | 347/62 |
| 4,894,664 | A | 1/1990 | Tsung Pan | |
| 6,000,787 | A | 12/1999 | Weber et al. | |
| 6,003,977 | A | 12/1999 | Weber et al. | |
| 6,019,907 | A | 2/2000 | Kawamura | |
| 6,065,823 | A | 5/2000 | Kawamura | |
| 6,113,221 | A | 9/2000 | Weber | |
| 6,137,443 | A | 10/2000 | Beatty et al. | |
| 6,302,523 | B1 | 10/2001 | Smith et al. | |
| 6,305,790 | B1 | 10/2001 | Kawamura et al. | |
| 6,402,301 | B1 | 6/2002 | Powers et al. | |
| 6,474,794 | B1 | 11/2002 | Anagnostopoulos et al. | |
| 6,534,247 | B2 | 3/2003 | Milligan et al. | |
| 6,719,913 | B2 | 4/2004 | Conta et al. | |
| 6,764,605 | B2 | 7/2004 | Donaldson et al. | |
| 6,929,352 | B2 | 8/2005 | Silverbrook | |
| 6,974,548 | B2 | 12/2005 | Giere et al. | |
| 2003/0081072 | A1 | 5/2003 | Trueba | |
| 2009/0102893 | A1 | 4/2009 | Junji et al. | |

FOREIGN PATENT DOCUMENTS

| | | | |
|---|---|---|---|
| JP | 10-095118 | A | 4/1998 |

* cited by examiner

*Primary Examiner* — Geoffrey Mruk

(57) ABSTRACT

An inkjet printhead (100) and a method (200) of supplying viscous ink employ a central ink feed channel (130). The inkjet printhead (100) includes a bridge beam (110) that supports an ejector element (106), a pair of lateral ink feed channels (120) adjacent to the bridge beam (110), and a central ink feed channel (130) through the ejector element (106) and bridge beam (110). The pair of lateral ink feed channels (120) and the central ink feed channel (130) connect between an ink reservoir (140) below the bridge beam (110) and the bubble expansion chamber (104). The method (200) includes providing (210) a central ink feed channel in a bridge beam of a printhead and flowing (220) viscous ink from an ink reservoir through a combination of the provided central ink feed channel and a pair of lateral ink feed channels.

16 Claims, 2 Drawing Sheets

INKJET PRINTHEAD AND METHOD EMPLOYING CENTRAL INK FEED CHANNEL

CROSS-REFERENCE TO RELATED APPLICATIONS

N/A

STATEMENT REGARDING FEDERALLY SPONSORED RESEARCH OR DEVELOPMENT

N/A

BACKGROUND

Inkjet printers and related inkjet devices have proven to be reliable, efficient, and generally cost effective means for the accurate delivery of precisely controlled amounts of ink and other related liquid materials onto various substrates such as, but not limited to, glass, paper, cloth, transparencies and related polymer films. For example, modern inkjet printers for consumer market digital printing on paper offer printing resolutions in excess of 2400 dots per inch (DPI), provide printing speeds greater than 20-30 sheets per minute, and deliver individual droplets of ink in a 'drop-on-demand' method that are often measured in picoliters. The relatively low costs, high print quality and generally vivid color output provided by these modern inkjet printers has made these printers the most common digital printer in the consumer market. Currently, in addition to the consumer market, there is considerable interest in employing inkjet printing for high-speed commercial and industrial applications.

In general, inkjet printheads used for drop-on-demand ink-jet printers and related inkjet printing systems may employ one of at least two technologies for ejecting droplets of ink. A first of these technologies employs a piezoelectric effect or a piezoelectric-based ejector element to eject the droplets from the printhead. The second of these technologies, often referred to as thermal inkjet printing, employs localized heat produced by the ejector element to vaporize a portion of the ink. A bubble produced by the vaporization expands to eject a remaining portion of the ink from the inkjet printhead as the droplet.

A limiting factor in the operation of inkjet printers is often a refill time of a bubble expansion chamber of the inkjet printhead. The refill time is particular problem when viscous inks are employed. Refill time directly and adversely impacts a firing rate or frequency of the inkjet printer.

BRIEF DESCRIPTION OF THE DRAWINGS

The various features of embodiments of the present invention may be more readily understood with reference to the following detailed description taken in conjunction with the accompanying drawings, where like reference numerals designate like structural elements, and in which.

Figure 1:
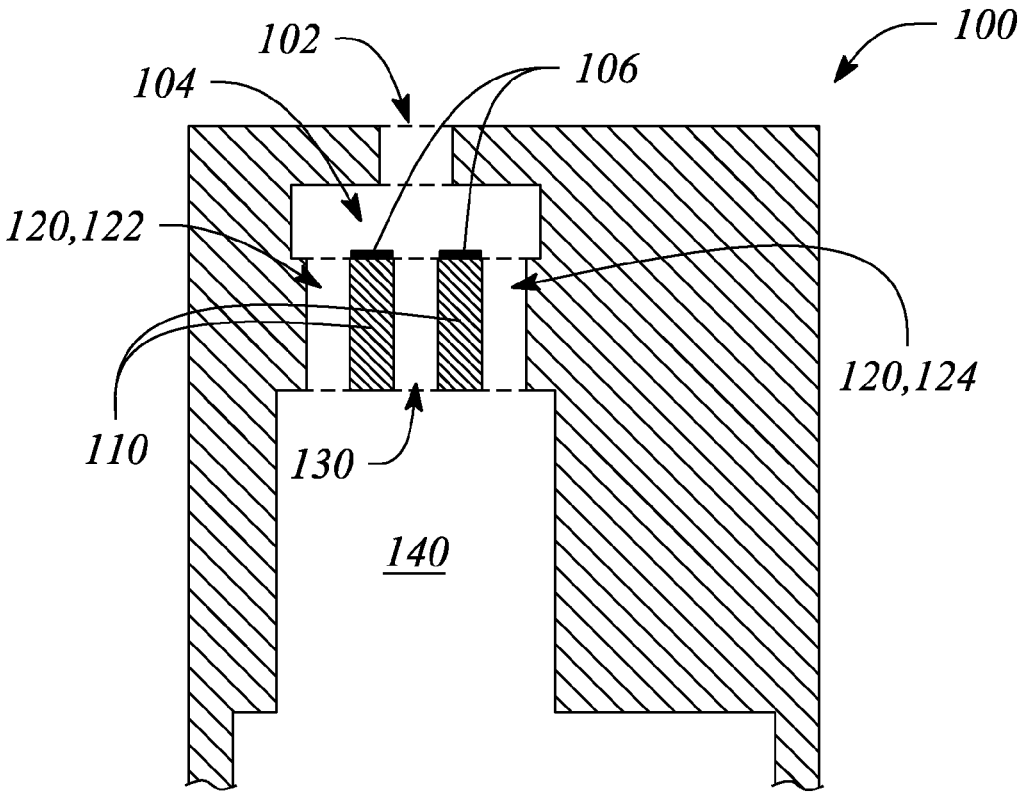
FIG. 1 illustrates a cross sectional view of an inkjet printhead, according to an embodiment of the present invention.

Certain embodiments of the present invention have other features that are one of in addition to and in lieu of the features illustrated in the above-referenced figures. These and other features of the invention are detailed below with reference to the preceding drawings.

DETAILED DESCRIPTION

Embodiments of the present invention facilitate high-speed ejection of ink droplets from an inkjet printhead. In some embodiments, high-speed ejection of ink having relatively high viscosity is facilitated, according to the present invention. In particular, viscous drag associated with higher viscosity inks may be overcome by generally improving a refill rate without adversely affecting 'blow-back' during ink ejection, according to various embodiments of the present invention. The improved refill rate directly increases a rate at which ink may be ejected from the printhead (e.g., the printhead firing rate). Embodiments of the inkjet printhead of the present invention employ a bridge beam architecture and include, but are not limited to, a thermal inkjet printhead.

In various embodiments of the inkjet printhead according to the present invention, an ejection element ejects ink as droplets from a nozzle of the printhead. The ejection element (e.g., a resistive heater) is typically located in a bubble expansion chamber below the nozzle. In some embodiments, the ejector element forms a bubble in the bubble expansion chamber. For example, the ejector element may comprise a resistive heater that vaporizes a portion of the ink to form the bubble. The bubble formed by the ejector element expands to eject the ink. In other embodiments, another in mechanism other than or in addition to an expanding bubble may be employed by the ejector element to eject the ink (e.g., a piezo-electric actuator or a micromechanical lever actuator). Regardless, herein a chamber over the ejector element and below the nozzle that holds ink for ejection by the ink printhead is referred to and defined as the 'bubble expansion chamber' whether or not an actual expanding bubble is employed to eject the ink.

Ink for ejection by the inkjet printhead is supplied to the bubble expansion chamber from an ink reservoir through a plurality of ink feed channels. In some embodiments, the ink reservoir is in direct communication with the bubble expansion chamber through or by way of the ink feed channels. For example, an input of the ink feed channel my be connected directly to the ink reservoir while an output is connected to the bubble expansion chamber. In other embodiments, another structure such as, but not limited to, a feed transition chamber my be located between the ink reservoir and the input of the ink feed channel. The feed transition chamber may facilitate cooling of the inkjet printhead, for example. In such embodiments, the ink feed channels are indirectly connected to the ink reservoir through the feed transition chamber, for example.

Further, according to various embodiments, the inkjet printhead of the present invention comprises a pair of lateral ink feed channels and a central ink feed channel. The lateral ink feed channels are spaced apart from one another. The central ink feed channel is disposed between the spaced apart lateral ink feed channels. The central ink feed channel effectively acts to augment a flow volume of ink flowing into the bubble expansion chamber. Moreover, the flow volume augmentation may effectively increase a flow rate of the ink from the ink reservoir into the bubble expansion chamber without adversely affecting blow-back during bubble expansion, for example.

In particular, the central ink feed channel effectively increases a flow volume of ink that is able to flow from the ink reservoir to bubble expansion chamber. The increased flow volume is relative to an ink flow volume that would have been provided by the lateral ink feed channels in the absence of the central ink feed channel. While the flow volume is increased, a cross sectional area of any one of the ink feed channels is not increased concomitant with the increase the flow volume. That is, individual ones of the various ink feed channels are not increased in cross sectional area to increase the flow volume. Since blow-back is more strongly correlated to a cross sectional area of the various individual feed channels than to a total flow volume provided by a combined action of various ink feed channels, the increase flow volume provided by the central channel has little or no effect on the blow-back. The term 'blow-back', as used herein, generally refers to and is defined as a tendency for ink to move backward through one or more feed channels that connect the ink reservoir to the bubble expansion chamber in response to an operation of the ejector element as a result of a pressure associated with bubble expansion). Backward movement is defined as from the bubble expansion chamber to the ink reservoir.

Embodiments of the inkjet printhead of the present invention employ a bridge beam architecture. The bridge beam is a structure that spans from a back to a front of the bubble expansion chamber. As such, the bridge beam effectively forms a bottom or a floor of the bubble expansion chamber, according to some embodiments. For example, sides of the bridge beam and therefore its width may be delineated or defined by the lateral ink feed channels. In particular, a pair of lateral ink feed channels may delineate a first side and a second side of the bridge beam. In such embodiments, the printhead comprises a bridge beam that supports the ejector element within the bubble expansion chamber. According to various embodiments, the central feed channel penetrates through the bridge beam to connect between the bubble expansion chamber and the ink reservoir. In some embodiments, the central feed channel effectively bisects the bridge beam and the associated ejector element.

In some embodiments, the bridge beam further separates the bubble expansion chamber from an ink chamber or ink reservoir. In particular, a top of the ink reservoir is in contact with a bottom of the bridge beam, in some embodiments. As such, a thickness of the bridge beam may effectively establish a distance between the ink reservoir and the bubble expansion chamber. As has already been discussed, in some embodiments, a feed transition chamber that facilitates cooling of the thermal inkjet printhead may be located between the ink reservoir and the bridge beam. In such embodiments, the thickness of the bridge beam may effectively establish a distance between the feed transition chamber and the bubble expansion chamber A substrate may be employed to realize the inkjet printhead during fabrication. In particular, the inkjet printhead may be fabricated in or from the substrate. Herein, a substrate is defined as a structure having a front side and a backside, the backside being defined as a side of the substrate opposite the front side. In some embodiments, the substrate may comprise a semiconductor material. For example, the substrate may comprise silicon (Si). The exemplary Si substrate may include Si that is either single crystalline, polycrystalline, or amorphous, for example. In some embodiments, the substrate may further comprise one or more of oxides and metals.

The bridge beam may comprise a material (e.g., silicon) of the body of the printhead, in some embodiments. For example, the bridge beam may comprise a material of the substrate from which the inkjet printhead is manufactured. In other embodiments, the bridge beam may comprise a metal such as, but not limited to copper (Cu) or tungsten (W). In yet other embodiments, the bridge beam may comprise an oxide such as, but not limited to, silicon dioxide ($SiO_2$). In various embodiments, one or both of the lateral ink feed channels and the central ink feed channel are formed by trenches formed in and penetrating through the material of the bridge beam.

As used herein, the article 'a' is intended to have its ordinary meaning in the patent arts, namely 'one or more'. For example, 'a central ink feed channel' generally means one or more central ink feed channels and as such, 'the central ink feed channel' means 'the central ink feed channel(s)' herein. Also, any reference herein to 'front', 'back', 'top', 'bottom', 'upper', 'lower', 'up', 'down', 'left' or 'right' is not intended to be a limitation herein but, is employed to establish a relative condition or location. Furthermore, terms such as 'about' and 'approximately' generally refer to a tolerance of ±10% about a value to which the term is applied unless otherwise specified herein. Moreover, examples herein are intended to be illustrative only and are presented for discussion purposes and not by way of limitation.

Figure 2:
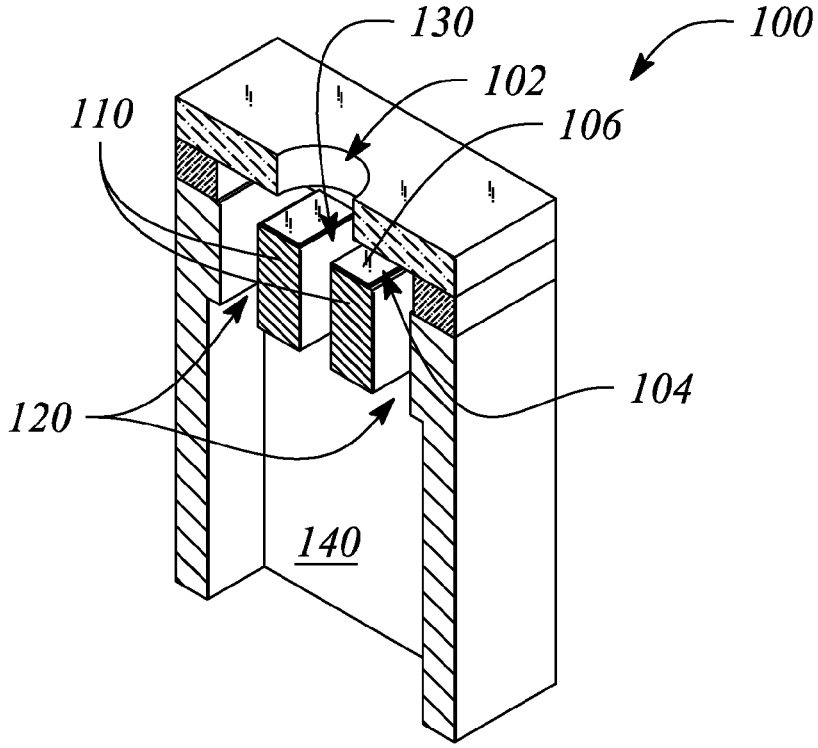
FIG. 2 illustrates a cut-away perspective view of an inkjet printhead, according to an embodiment of the present invention.

FIG. 1 illustrates a cross sectional view of an inkjet printhead 100, according to an embodiment of the present invention. FIG. 2 illustrates a cut-away in perspective view of an inkjet printhead 100, according to an embodiment of the present invention. During operation, the printhead 100 ejects ink as droplets (not illustrated) from a nozzle 102. A rate or frequency at which the droplets are ejected is defined as a firing rate or speed of the inkjet printhead.

The ink is ejected from the nozzle 102 of the inkjet printhead 100 by the operation or action of an ejector element 106. In some embodiments, the ejector element 106 creates an expanding bubble in a bubble expansion chamber 104 below (e.g., below as illustrated) the nozzle 102. As illustrated, the ejector element 106 is located at a bottom of the bubble expansion chamber 104. In some embodiments, the ejector element 106 comprises a heater. For example, the heater may comprise a resistor that heats up when a current flows through the resistor. During operation of the inkjet printhead 100, the heater 106 applies heat to the ink within the bubble expansion chamber 104. A portion of the ink is vaporized by the heat and to form the expanding bubble. The expanding bubble then forces ink remaining in a liquid form above the bubble out of the bubble expansion chamber 104 through the nozzle 102.

According to various embodiments of the present invention, the inkjet printhead 100 comprises a bridge beam 110. The bridge beam 110 spans across a portion of a bottom of the bubble expansion chamber 104. The bridge beam 110 further supports the ejector element 106. In some embodiments, the bridge beam 110 comprises an area essentially equivalent to an area of the ejector element 106. In some embodiments, the bridge beam 110 is relatively thick. For example, the bridge beam 110 may have a thickness that is greater than about 10 microns (μm). In some embodiments, the bridge beam 110 may be between 10 μm and about 100 μm thick. For example, the bridge beam 110 may be about 15-25 μm thick.

In some embodiments, the bridge beam 110 comprises a material of the inkjet printhead 100 or of a body of the printhead (not separately labeled in FIG. 1). For example, the body of the inkjet printhead 100 and the bridge beam 110 may comprise silicon (Si). In other embodiments, the bridge beam 110 may comprise a material that exhibits good heat conductivity. In particular, in such embodiments, the bridge beam 110 may comprise a material other than or in addition to the material of the printhead body. For example, the other material may be chosen to have a thermal conductivity that is higher than the printhead body. The inkjet printhead 100 may comprise Si while the bridge beam 110 may comprise a metal known to have a higher thermal conductivity than Si such as, but not limited to, copper (Cu) and tungsten (W), for example.

The inkjet printhead 100 further comprises a pair of lateral ink feed channels 120 adjacent to the bridge beam 110. In some embodiments, the lateral ink feed channels 120 are disposed on either side of the bridge beam 110 at a base of the bubble expansion chamber 104. In some of these embodiments, the lateral ink feed channels 120 is symmetrically disposed on either side of the bridge beam 110. The pair of lateral ink feed channels 120 provides a conduit for supplying ink to the bubble expansion chamber 104. In some embodiments, the lateral ink feed channels 120 have a rectangular cross sectional shape.

For example, as illustrated in FIGS. 1 and 2, a first lateral ink feed channel 122 is located on a first side of the bridge beam 110 while a second lateral ink feed channel 124 is located on a second side of the bridge beam 110. As such, the first lateral ink feed channel 122 is spaced apart from the second lateral feed channel 124 by the bridge beam 110 effectively defining respective first and second sides to the bridge beam 110. That is, a distance between the first and second lateral ink feed channels 122, 124 defines a width of the bridge beam 110.

Further as illustrated, the exemplary first lateral ink feed channel 122 and exemplary second lateral ink feed channel 124 are symmetrically located on and extend along opposite sides of the bridge beam 110. In particular, as is illustrated in FIG. 2, the first and second feed channels 122, 124 are effectively rectangular holes in a bottom of the bubble expansion chamber 104 while the bridge beam 110 is effectively a floor of the bubble expansion chamber 104. In some embodiments (e.g., as illustrated), the lateral ink feed channels 120 of the pair have a length that is effectively equal to the thickness of the bridge beam 110. For example, a thickness of the bridge beam 110 and a length of the lateral ink feed channels 120 of the pair may be greater than about 10 and less than about 100 μm.

The inkjet printhead 100 further comprises a central ink feed channel 130. As illustrated, the central ink feed channel penetrates through the bridge beam 110. In some embodiments, the central ink feed channel 130 effectively bisects the bridge beam 110 (e.g., as illustrated). The central ink fed channel 130 also bisects the ejector element 106, as illustrated. Further as illustrated, the central ink feed channel 130 is below and coaxial with the nozzle 102. As such, the central ink feed channel 130 is effectively disposed in a center of the bridge beam 110, as illustrated. In other embodiments (not illustrated), the central ink feed channel 130 may be closer to one of the lateral ink feed channels that to the other lateral ink feed channel. In other words, the central ink feed channel 130 may be offset from a center of the bridge beam 110, according to other embodiments. In such embodiments, the ejector element 106 may be one of located only on one side of the central ink feed channel 130 or located on both sides of the central ink feed channel 130, albeit in a manner that is consistent with a relative area of a top surface of the bridge beam 110 on either side of the central ink feed channel 130. For example, the ejector element 130 may comprise a split ejector element 130 that is located on portions of the bridge beam 110 top surface on both sides of the central ink feed channel 130.

In some embodiments, the ejector element 106 comprises a resistor affixed to a top of the bridge beam 110 (e.g., a top surface). In such embodiments, the central ink feed channel 130 may effectively split the resistor (or equivalently the ejector element 106). Such embodiments may be referred to as a 'split resistor' configuration.

In some embodiments, the central ink feed channel 130 has a rectangular cross sectional shape. For example, the central ink feed channel 130 may have a cross sectional shape effectively similar to that of the lateral ink feed channels 120. In other embodiments, the central ink feed channel 130 has a non-rectangular cross sectional shape. For example, the central feed channel 130 may have a circular or an oval cross sectional shape (not illustrated). In some embodiments, the central ink feed channel 130 may have a cross sectional area that is effectively similar to one of the lateral ink feed channels 120. In some embodiments, the central ink feed channel 130 may comprise a plurality of channels (not illustrated). For example, the central ink feed channel 130 may comprise a row of circular holes (not illustrated) that bisect the bridge beam 110. Herein, 'cross sectional shape' and 'cross sectional area' of an ink feed channel are defined respectively as a shape and an area of the ink feed channel in a plane that is largely perpendicular to a flow direction of ink flowing in the ink feed channel.

In some embodiments, a ratio of a width of the central ink feed channel 130 to a width of a portion of the bridge beam 110 on either side of the central ink feed channel 110 is between about 0.5 and 2.0. For example a width of the bridge beam portion on a left of the central ink feed channel 130 may be about 7.5 μm and the width of the central ink feed channel 130 may be about 10 μm. A ratio of 10 μm to 7.5 μm is about 1.33 (i.e., 10 μm/7.5 μm=1.333 . . . ), which is clearly between 0.5 and 2.0. In another example, the portions of the bridge beam 110 on either side of the central ink feed channel 130 may be each about 10 μm wide while the central ink feed channel 130 has a width of about 9 μm (i.e. a ratio of 9 μm/10 μm=0.9). In some embodiments, the ratio of the width is between about 1.0 and 1.5. For example, the width of the central ink feed channel 130 and an adjacent the bridge beam portion may both be about 7.0 μm.

In some embodiments, a volume of the pair of lateral ink feed channels 120 combined with a volume of the central ink feed channel 130 is between about 0.5 to about 10.0 times a volume of the bubble expansion chamber 104 combined with a volume of the nozzle 102. In some embodiments, a volume of the combined pair of lateral ink feed channels 120 and central ink feed channel 130 is between about 0.5 to about 2.0 times a volume of the bubble expansion chamber 104 and the nozzle 102.

In some embodiments, one or both of the lateral ink feed channels 120 may have a width between about 5 μm and about 50 μm and a length of between about 10 μm and about 100 μm. In some embodiments, the central ink feed channel 130 may be similarly sized. In some embodiments, the central ink feed channel 130 has a depth that is less than a depth of one or both of lateral ink feed channels 120. Herein, the 'depth' is defined as a dimension that is perpendicular to both of the width and the length. In some embodiments, the depth of the ink feed channels 120, 130 is greater than the width of the ink feed channels 120, 130. For example, the lateral ink feed channels 120 may have a length of 100 μm, a width of 10 μm and a depth of 40 μm. In a similar example, the central feed channel may have a length that is 100 μm, a width of 7 μm and a depth of 30 μm.

The inkjet printhead 100 further comprises an ink reservoir 140. The ink reservoir 140 serves as a source of ink for the thermal inkjet printhead 100. The ink reservoir 140 is located at a bottom of the bridge beam 110 and at input ends of the ink feed channels 120, 130, in some embodiments. Ink from the ink reservoir 140 passes through a combination of the lateral ink feed channels 120 and central ink feed channel 130 on its way to bubble expansion chamber 104.

In some embodiments, the inkjet printhead 100 employs viscous ink. Herein, viscous ink is defined as ink having a viscosity of greater than about 2 centipoise (cP). In some embodiments, the viscous ink has a viscosity of greater than about 5 cP. In some embodiments, viscous ink is defined as ink having a viscosity in a range from about 2 cP to about 15 cP. The central ink feed channel 130 facilitates the use of such viscous ink by the inkjet printhead 100. In particular, the lateral ink feed channels 120 and central ink feed channel 130 cooperate to communicate the viscous ink from the ink reservoir 140 to the bubble expansion chamber 104 of the inkjet printhead 100. The central ink feed channel 130 provides additional viscous ink without increasing blow-back.

Figure 3:
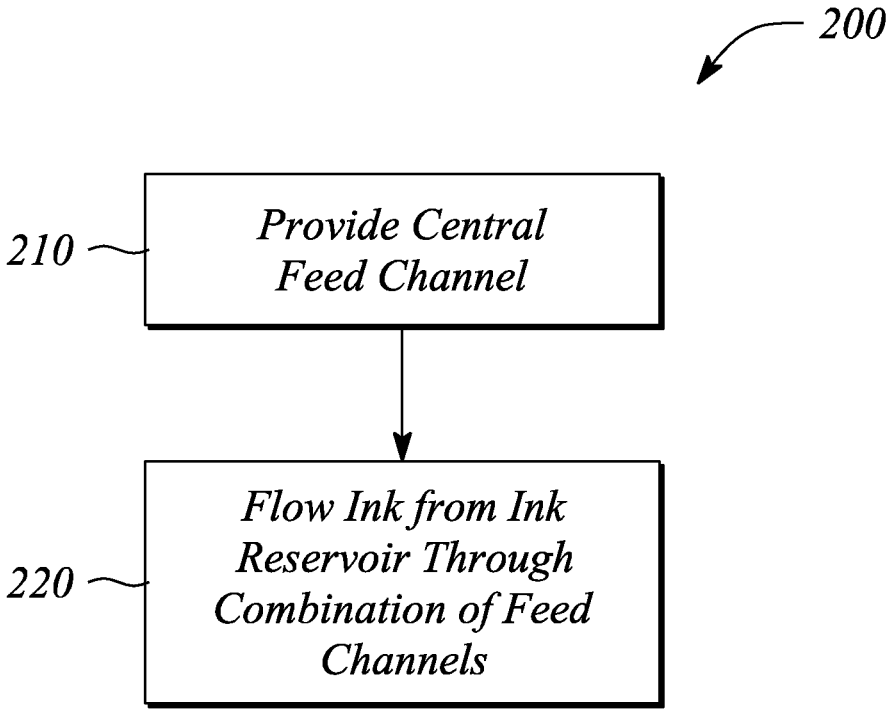
FIG. 3 illustrates a flow chart of a method of supplying viscous ink to a printhead in an inkjet system, according to an embodiment of the present invention.

FIG. 3 illustrates a flow chart of a method 200 of supplying viscous ink to a printhead in an inkjet system, according to an embodiment of the present invention. The method 200 supplying viscous ink may increase a firing rate of a printhead of an ink jet system compared to other methods of supplying ink. The method 200 of supplying viscous ink may further minimize or effectively eliminate problems of blow-back that are or may be associated with other methods.

The method 200 of supplying viscous ink comprises providing 210 a central ink feed channel in a bridge beam of the printhead. The bridge beam spans between a pair of lateral ink feed channels. According to some embodiments, the bridge beam may support and ejector element. The provided 210 central ink feed channel may effectively bisect the bridge beam and supported ejector element, according to some embodiments. Further, the bridge beam and ejector element, the lateral ink feed channels, and the provided 210 central ink feed channel may be effectively similar respectively to the bridge beam 110 and ejector element 106, the lateral ink feed channels 120, and central ink feed channel 130 described above with respect to the inkjet printhead 100, according to some embodiments.

The method 200 of supplying viscous ink further comprises flowing 220 ink from an ink reservoir through a combination of the provided 210 central ink feed channel and the pair of lateral ink feed channels. In particular, the provided central ink feed channel and the pair of lateral ink feed channels cooperate to provide a volume of the viscous ink to a bubble expansion chamber of the printhead. The volume is sufficient to fill the bubble expansion chamber and is provided after ejection by the ejector element from of previously provided ink from the bubble expansion chamber. In some embodiments, the viscous ink has a viscosity greater than about 2 cP. In some embodiments the viscous ink has a viscosity of greater than about 15 cP.

In some embodiments, a ratio of a width of the provided central ink feed channel to a width of a portion of the bridge beam on either side of the central ink feed channel is between about 0.5 and 2.0, according to the method 200. In some embodiments, the ratio of the width is between about 1.0 and 1.5. In some embodiments, the central ink feed channel is provided 210 by etching a trench in a material of the bridge beam, the trench being deep enough to penetrate through the bridge beam to connect the bubble expansion chamber to an ink reservoir located below the bridge beam.

Thus, there have been described embodiments of an inkjet printhead and a method of supply viscous ink to a printhead of an inkjet system that employ central ink feed channel in a bridge beam. It should be understood that the above-described embodiments are merely illustrative of some of the many specific embodiments that represent the principles of the present invention. Clearly, those skilled in the art can readily devise numerous other arrangements without departing from the scope of the present invention as defined by the following claims.

What is claimed is:

1. An inkjet printhead comprising:

a bridge beam that supports an ejector element within a bubble expansion chamber below a nozzle;

a pair of lateral ink feed channels adjacent to the bridge beam, the pair of lateral ink feed channel being spaced apart by and located on opposite sides of the bridge beam to define a width of the bridge beam; and a central ink feed channel through the ejector element and bridge beam, the central feed channel being coaxial with the nozzle, wherein the pair of lateral ink feed channels and the central ink feed channel connect between an ink reservoir below the bridge beam and the bubble expansion chamber.

2. The inkjet printhead of claim 1, wherein a ratio of a width of the central ink feed channel to a width of a portion of the bridge beam on either side of the central ink feed channel is between about 0.5 and 2.0.

3. The inkjet printhead of claim 2, wherein the ratio of the widths is between about 1.0 and 1.5.

4. The inkjet printhead of claim 1, wherein the ejector element comprises a resistor affixed to a top of the bridge beam, the resistor being split by the central ink feed channel.

5. The inkjet printhead of claim 1, wherein both a thickness of the bridge beam and a length of the lateral ink feed channels and the central ink feed channel are greater than about 10 microns and less than about 100 microns (μm).

6. The inkjet printhead of claim 1, wherein one or both of the lateral ink feed channels has a width between about 5 μm and about 50 μm and a length of between about 10 μm and about 100 μm.

7. The inkjet printhead of claim 1, wherein the bridge beam comprises silicon (Si).

8. The inkjet printhead of claim 1, wherein a volume of the lateral ink feed channels combined with a volume of the central ink feed channel is between about 0.5 to about 10.0 times a volume of the bubble expansion chamber and the nozzle.

9. The inkjet printhead of claim 1, where the central ink feed channel has a depth that is less than a depth of one or both of lateral ink feed channels the depth being a dimension that is perpendicular to both the width and the length and wherein the depth of the lateral ink feed channels is greater than the width of the lateral ink feed channels.

10. An inkjet system comprising:

a printhead, the printhead comprising:

an ejector element;

a bridge beam to support the ejector element within a bubble expansion chamber below a nozzle;

a pair of lateral ink feed channels the lateral ink feed channels being adjacent to and disposed on either side of the bridge beam of the printhead; and a central ink feed channel through the ejector element and the bridge beam, the central feed channel being coaxial with the nozzle; and an ink reservoir, the lateral and central ink feed channels connecting between the ink reservoir and the bubble expansion chamber, wherein the lateral ink feed channels and the central ink feed channel cooperate to communicate a viscous ink from the ink reservoir to the bubble expansion chamber.

11. The inkjet system of claim 10, wherein both a thickness of the bridge beam and a length of the ink feed channels are greater than about 10 microns (μm) and less than about 100 μm.

12. The inkjet system of claim 10, wherein a ratio of a width of the central ink feed channel relative to a width of the ejector element on a portion of the bridge beam between the central ink feed channel and one of the lateral ink feed channels is between about 0.5 and 2.0.

13. The inkjet system of claim 10, wherein the ejector element comprises a resistor that is split into two portions by and is located on either side of the central ink feed channel.

14. The inkjet system of claim 10, further comprising the viscous ink having a viscosity greater than about 2 centipoise (cP).

15. A method of supplying viscous ink to a printhead in an inkjet system, the method comprising:

providing a central ink feed channel in a bridge beam of the printhead, the bridge beam supporting an ejector element within a bubble expansion chamber below a nozzle and spanning between a pair of lateral ink feed channels, the central ink feed channel being through the ejector element and the bridge beam; and flowing viscous ink from an ink reservoir through a combination of the central ink feed channel and the pair of lateral ink feed channels to the bubble expansion chamber, wherein the viscous ink has a viscosity greater than about 5 centipoise (cP), and wherein the central ink feed channel is coaxial with the nozzle.

16. The method of supplying viscous ink to the inkjet printhead of claim 15, wherein a ratio of a width of the central ink feed channel to a width of a portion of the bridge beam on either side of the central ink feed channel is between about 0.5 and 2.0.

* * * * *

UNITED STATES PATENT AND TRADEMARK OFFICE

CERTIFICATE OF CORRECTION

PATENT NO. : 8,419,169 B2
APPLICATION NO. : 13/260075
DATED : April 16, 2013
INVENTOR(S) : Alfred I-Tsung Pan et al.

It is certified that error appears in the above-identified patent and that said Letters Patent is hereby corrected as shown below:

In the Claims:

In column 8, line 32, in Claim 9, delete “channels” and insert -- channels, --, therefor.

In column 8, line 41, in Claim 10, delete “channels” and insert -- channels, --, therefor.

Signed and Sealed this
Thirteenth Day of August, 2013

Teresa Stanek Rea
*Acting Director of the United States Patent and Trademark Office*